US006014078A

United States Patent [19]

Rojas et al.

[11] Patent Number: 6,014,078

[45] Date of Patent: Jan. 11, 2000

[54] MONITORING SYSTEM FOR WEIGHT LIFTING IMPLEMENTS

[75] Inventors: Michael D. Rojas, Tustin; Scott J. Frasco, Huntington Beach, both of Calif.

[73] Assignee: Iron Grip Barbell Company, Inc., Costa Mesa, Calif.

[21] Appl. No.: 09/213,939

[22] Filed: Dec. 17, 1998

[51] Int. Cl.[7] ..... G08B 13/14; A63B 21/075

[52] U.S. Cl. ..... 340/568.6; 340/323 R; 340/686.1; 482/108; 482/901

[58] Field of Search ..... 340/572.1, 572.2, 340/825.54, 568.6, 323 R, 323 B, 685, 686.1, 686.2; 482/1, 108, 901; 235/375, 383, 385

[56] References Cited

U.S. PATENT DOCUMENTS

| | | | |
|---|---|---|---|
| 5,028,909 | 7/1991 | Miller | 340/568.6 |
| 5,048,826 | 9/1991 | Ryan | 482/7 |
| 5,565,845 | 10/1996 | Hara | 340/568.6 |
| 5,725,460 | 3/1998 | Marsh | 482/104 |
| 5,785,632 | 7/1998 | Greenberg et al. | 482/5 |

*Primary Examiner*—Jeffery A. Hofsass
*Assistant Examiner*—Van T. Trieu
*Attorney, Agent, or Firm*—Darby & Darby

[57] ABSTRACT

A monitoring system is provided for detecting and identifying weight lifting implements placed on a weight lifting storage device, such as a rack. In the event the implements are placed in improper locations on the storage device, the monitoring system is operative to generate an error signal, which may be in the form of an audible or visual signal to signal the person replacing the implement that he or she is returning the implement to an improper location.

20 Claims, 8 Drawing Sheets

MONITORING SYSTEM FOR WEIGHT LIFTING IMPLEMENTS

BACKGROUND OF THE INVENTION

1. Field of the Invention

The present invention relates to electrical monitoring systems. More particularly, the invention relates to a monitoring system that monitors the return of weight lifting implements to a weight lifting implement receptacle, and that determines whether one or more of the weight lifting implements are improperly placed on the receptacle.

2. Discussion of the Related Art

Gyms and health clubs have been and continue to be a very popular place for people to exercise. Most gyms and health clubs offer weight lifting implements such as free weights, for example dumbbells and barbells, as well as machine weights such as NAUTILUS™ machines. While gyms and health clubs offer a valuable service, there are certain drawbacks as well. First of all, because exercising continues to be very popular, many gyms are often crowded, especially at peak hours such as in the early evening. When gyms are crowded, gym members will often have to wait to use particular equipment, which adds to the amount of time one must spend at the gym.

Another common problem with gyms is that one often must hunt for a particular piece of equipment, and hope that the previous user of that piece of equipment returned it to its proper location. This is especially true with respect to dumbbells, barbells, and other "mobile" weight lifting implements (devices which can be moved around the gym by users). For example, dumbbells are usually stored on a rack, which is typically in the form of a frame that defines a plurality of upwardly facing, concave cradles sized to receive the various dumbbells. A typical rack also includes a plurality of indicia that associate each of the cradles with a particular dumbbell. For example, a cradle may have the number "50" printed on or very close to it, indicating that it is intended to store a 50 pound dumbbell. However, each cradle is typically the same size and will thus receive any of the dumbbells. Thus, due to a person's mistake or simply laziness, dumbbells are frequently not replaced in the proper cradle, leading to frustration for future users who must seek out the misplaced dumbbell. When more than one user must look for misplaced dumbbells, that can potentially cause congestion in front of the rack, which results in a safety hazard as many people search for and retrieve their desired dumbbells. Also, throughout and at the end of the day, gym personnel will have to reorganize the misplaced implements, which is time-consuming and inefficient. In addition, because many of the implements are quite heavy, any unnecessary movement of those implements is undesirable due to the fact that it can lead to injury.

There currently exists no solution for this problem. Both gym users and gym personnel must rely on the previous users of the weight lifting implements to properly replace the implements they use. This does not happen in a significant number of instances, causing gym members and personnel to spend time searching for particular implements.

Accordingly, it will be apparent that there continues to be a need for a system that monitors the placement ol mobile weight lifting implements like dumbbells, barbells, and the like, and that ensures that those implements are properly replaced after use, so that the next user can quickly and reliably find the desired implement. The present invention addresses these and other needs.

SUMMARY OF THE INVENTION

Briefly, and in general terms, the present invention in one illustrative embodiment is directed to a monitoring system for detecting weight lifting implements returned to respective receptacles formed in a weight lifting storage device, such as a rack. In the event the implements are placed in improper locations in or on the storage device, the monitoring system is operative to generate an error signal, which may be in the form of an audible or visual signal to alert the person replacing the implement that he or she is returning the implement to an improper location.

Thus, the present invention in one illustrative embodiment comprises: plural transmitters, each transmitter adapted to be connected to a respective weight lifting implement and operative to transmit a unique identification signal to identify the corresponding implement; plural receivers, each receiver adapted to be mounted on a weight lifting storage device at a predetermined location, each receiver being responsive to receipt of an identification signal from one of the transmitters to generate a corresponding signal; a memory associating the identification signals from the respective transmitters with corresponding receivers; and a processor in electrical communication with each receiver and programmed to receive signals from the receivers, to access the memory to determine if the receiver transmitting the signal corresponds to the transmitter generating the identification signal and, if not, to generate an error signal.

The present invention in another illustrative embodiment is directed to a system for monitoring plural weight lifting implements, the system comprising: a weight lifting storage device with plural receptacles configured to receive the respective weight lifting implements; plural transmitters, each transmitter connected to a respective one of the implements and operative to transmit a unique identification signal to identify the corresponding implement; plural receivers mounted on the storage device at predetermined locations, each receiver being responsive to receipt of an identification signal from one of the transmitters to generate a corresponding signal; a memory associating the identification signals from the respective transmitters with corresponding receivers; and a processor coupled to each receiver and programmed to receive signals from the receivers, to access the memory to determine if the receiver transmitting the signal corresponds to the transmitter generating the identification signal and, if not, to generate an error signal.

The present invention in yet another illustrative embodiment is directed to a method of monitoring plural weight lifting implements comprising: associating the implements with respective receptacles of a weight lifting storage device; sensing the placement of an implement in a particular one of the receptacles; determining the identity of the implement; determining if the implement is associated with the receptacle in which the implement is placed; and, if the implement is not associated with the receptacle, actuating an alarm.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein.

DETAILED DESCRIPTION OF THE PREFERRED EMBODIMENTS

Figure 1:
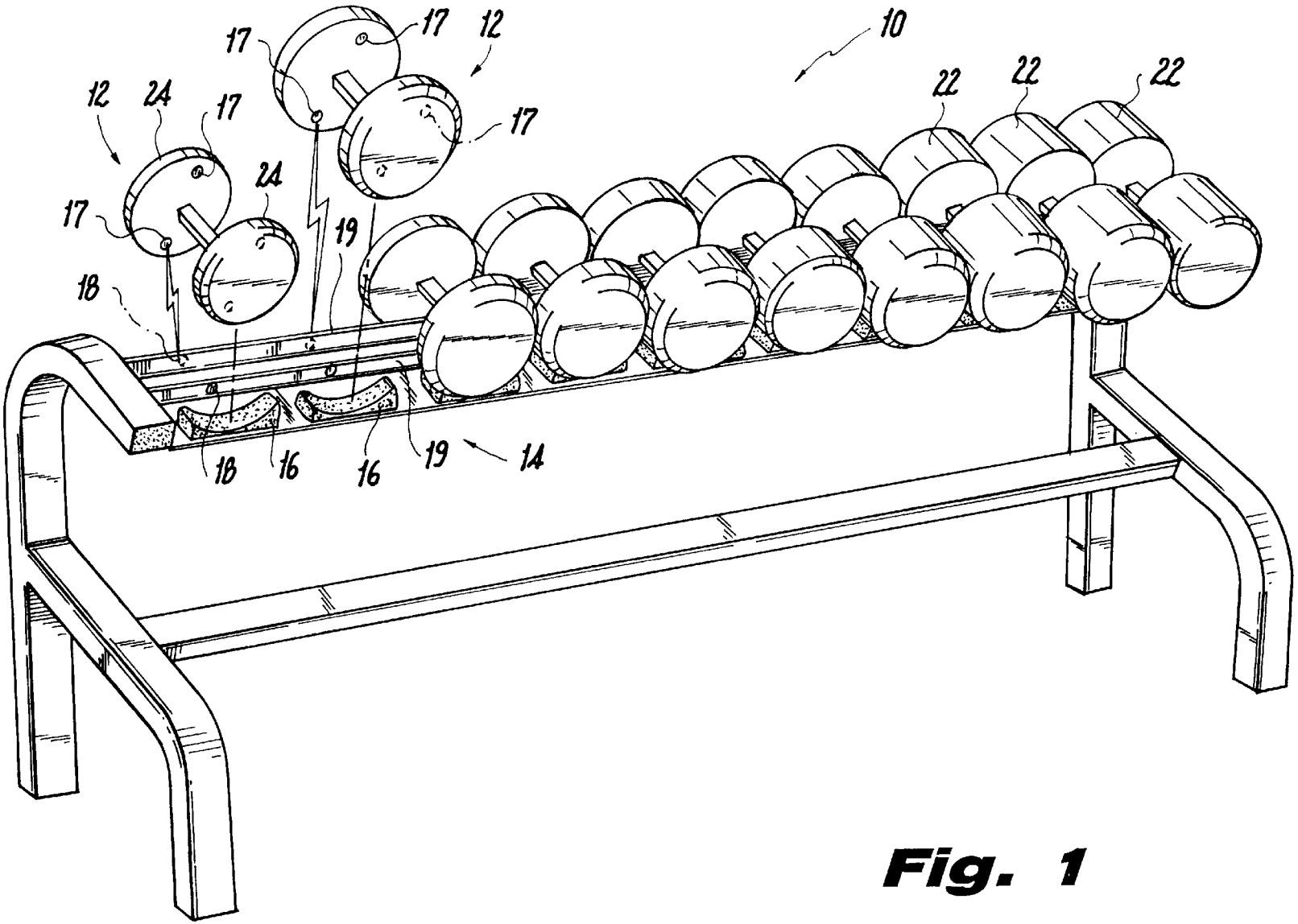
FIG. 1 is a perspective view of various components of a weight lifting implement monitoring system according to one illustrative embodiment of the present invention and incorporated in a dumbbell and rack.

Referring now to FIG. 1, one illustrative embodiment of a weight lifting implement monitoring system 10 is shown. The monitoring system 10 is operative to detect the placement of a weight lifting implement 12, for example a dumbbell 22, in or on a particular receptacle of a weight lifting implement storage device 14, for example a cradle 16 formed in a conventional dumbbell rack. The system is operative to determine the identity of the dumbbell and of the cradle in which the dumbbell is placed, and determine whether that cradle is the proper one for the particular dumbbell. If the cradle is not the proper one for that dumbbell, the system generates an error signal, which may be stored in a memory for future retrieval, or transmitted to an alarm device to signal the alarm device to generate an audible, visual, or other signal to alert the person replacing the dumbbell that the dumbbell is being placed in the wrong cradle.

In the illustrative embodiment shown, the system 10 includes one or more electrical-to-optical transducers or other type of transmitter 17 that are operative to transmit optical signals, radio frequency (RF) signals, and the like. The system also includes one or more optical-to-electrical transducers or other type of receiver 18 that are operative to receive optical signals, RF signals, and the like, and to generate corresponding electrical signals.

Referring to FIG. 1, the weight lifting implement storage device 14 in one illustrative embodiment is in the form of a dumbbell rack with plural cradles 16 configured to receive corresponding dumbbells 22. The rack is of conventional, well known design, and is modified in accordance with the present invention to include the receivers 18, which comprise, for example, optical or RF detectors that are responsive to sensing optical or RF signals to generate corresponding electrical signals. The receivers may take many different forms, such as photo transistors, photo diodes, infrared detectors, RF receivers, and the like, all of which are well known to those of ordinary skill in the art.

In one illustrative embodiment, as shown in FIG. 1, the receivers 18 are mounted to respective rails 19 adjacent the respective cradles 16 of the weight rack 14. Preferably, the receivers are recessed a selected distance from the surface of the rails to prevent the dumbbells from damaging the receivers as the dumbbells are replaced in the cradles. It will be understood by those of ordinary skill in the art that the receivers may alternately be placed in virtually any other location on or near the cradles. Thus, the placement shown in the figures is intended to be exemplary only.

The transmitters 17 in one embodiment are disposed on the inwardly facing surface of one of the plates 24 of the dumbbells 22. In one illustrative embodiment, each dumbbell includes more than one transmitter, with the transmitters being located at preselected spaced apart locations on the inwardly facing surface of one of the dumbbell plates. Also, the transmitters can be mounted on the inwardly facing surfaces of both plates of each dumbbell. It will be understood that each dumbbell may alternatively include only one transmitter. The transmitters preferably are designed to create a widely dispersed signal to ensure that communication is established with the respective receivers 18 in the cradles. Rather than being located on the inwardly facing surfaces of the dumbbell plates, the transmitters 17 could alternatively be placed on the outer face of the plates, on the handles 26 of each dumbbell, or in any other suitable location. In the case where there are two transmitters per dumbbell, the transmitters are preferably disposed on generally diametrically opposed sides of the same plate to ensure communication with the respective receivers 18 on the rails 19 (see FIGS. 1 and 2).

The transmitters 17 may take many different forms, such as photo emitters, LEDs or other optical emitters, infrared emitters, RF transmitters, and the like. In one embodiment, the transmitters are operative to transmit unique identification signals to identify the corresponding dumbbell with which they are associated. In the case of multiple transmitters mounted on each dumbbell, each transmitter mounted to a particular dumbbell will transmit the same identification signal, while transmitters mounted to different dumbbells will transmit different signals. The unique identification signals can take many different forms. In one illustrative embodiment, the transmitters comprise RF transmitters, each of which transmits at a different frequency to be distinguished by the system 10, as described in greater detail below.

Figure 2:
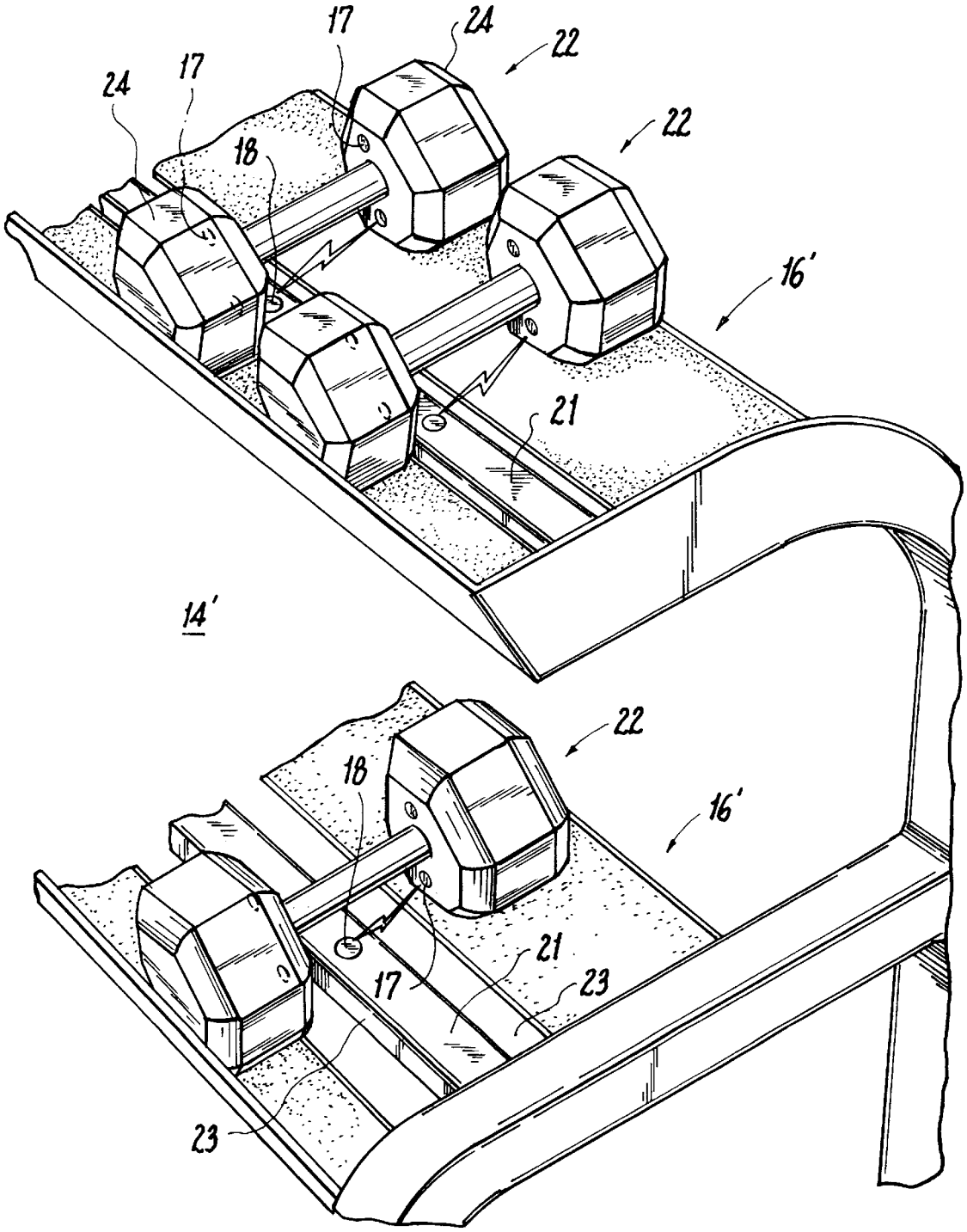
FIG. 2 is a perspective, fragmented view, of a rack similar to the rack shown in FIG. 1 and having dumbbells placed in the rack.

Referring to FIG. 2, there is shown an alternative embodiment of the system 10 of the present invention, in which the system is incorporated into a two-level dumbbell rack 14' which has preselected locations 16' for each of the dumbbells (for sake of simplicity, these locations are referred to herein as "cradles"). In this embodiment, the receivers 18 are mounted in a track 21 which is interposed between the plates 24 of the dumbbells 22. The receivers could alternatively be mounted on the upstanding side walls 23 of the track 21, or in any other suitable location, so long as the receiver 18 can receive the signals from the transmitter 17.

Figure 3:
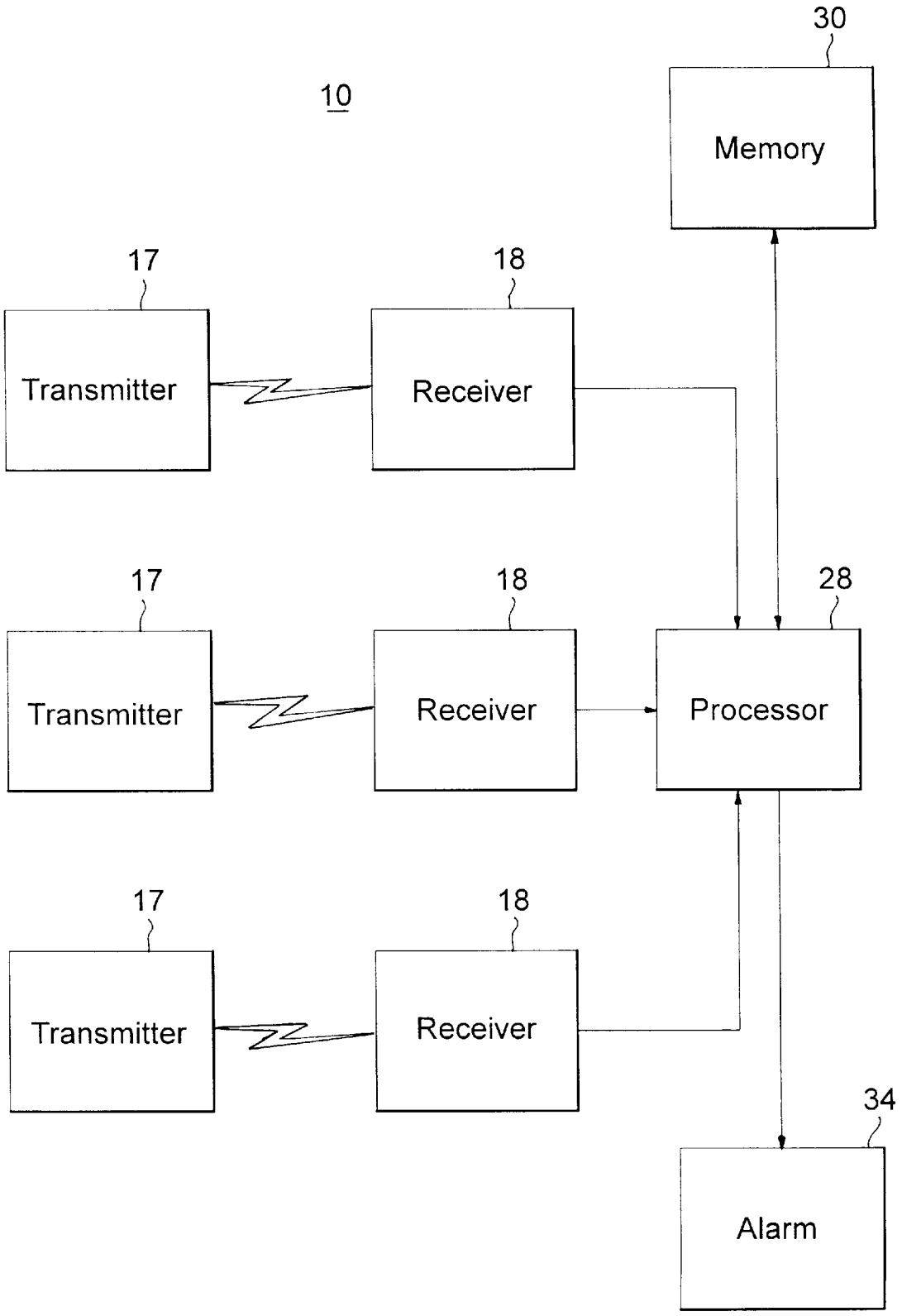
FIG. 3 is a block diagram of the electrical and optical components of the system of FIG. 1.

Referring now to FIG. 3, the system 10 further includes circuitry, preferably in the form of a processor 28, that is electrically coupled to each of the receivers 18 to receive electrical signals from one or more of those receivers. The processor is programmed to receive signals from the receivers, determine the identity of the dumbbell and of the cradle in which the dumbbell is placed, and determine if the dumbbell is in the proper location, as described in greater detail below in connection with FIG. 4.

Figure 5:
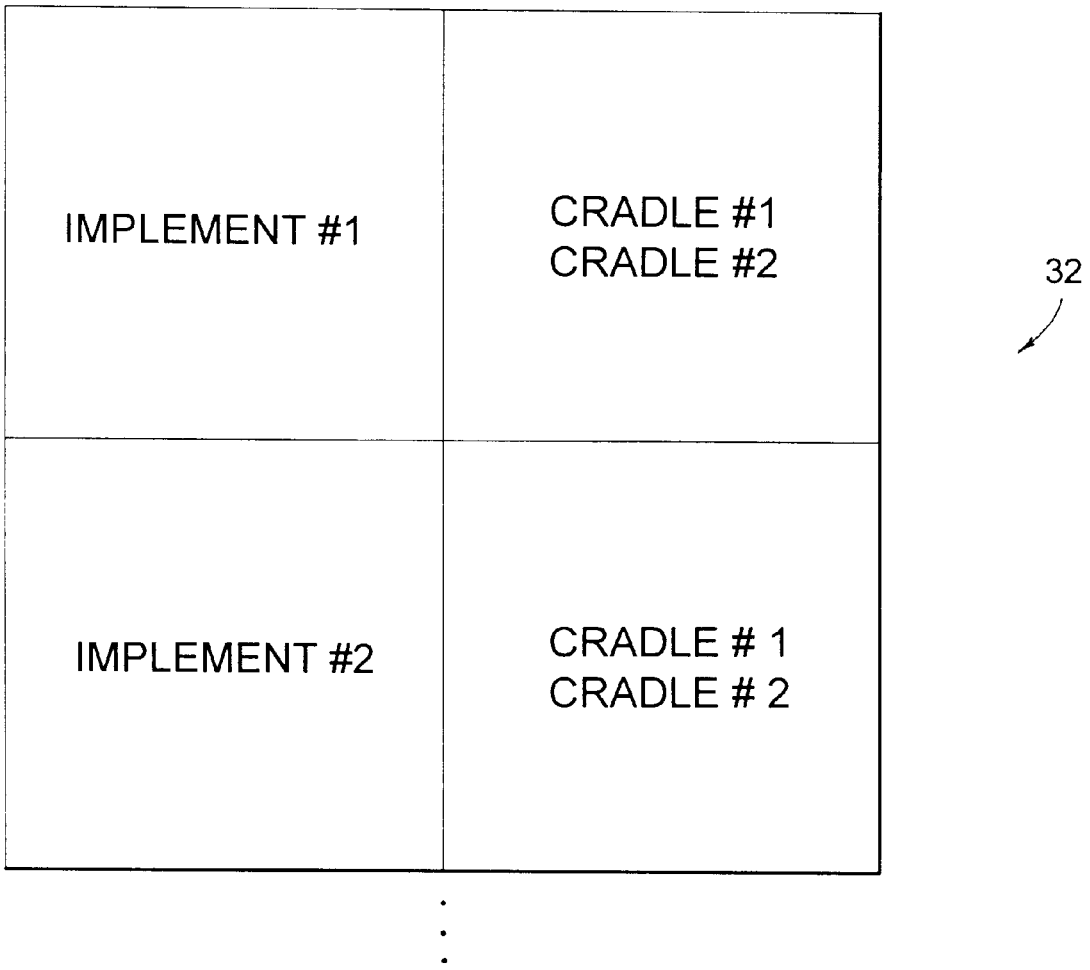
FIG. 5 is a block diagram of an association table maintained by the system of FIG. 1.

The processor 28 is electrically connected to a memory 30, the memory storing data that associates each of the weight lifting implements with a corresponding one of the cradles. The memory in one embodiment is in the form of an association or look-up table 32 (FIG. 5) that associates each implement (or the unique signal identifying that implement) with one or more cradles (or the receivers associated with the respective cradles). For example, in the case of dumbbells, each of the dumbbells will be associated with two cradles, because dumbbells typically come in pairs. Thus, there will be two 50 pound dumbbells and two cradles designated to receive the 50 pound dumbbells, such that either of the 50 pound dumbbells can be placed in either of the 50 pound cradles. Thus, in FIG. 5, the entry for "Implement #1" corresponds, for example, to a 50 pound dumbbell, which can be placed in either "Cradle #1" or "Cradle #2", which are the two 50 pound cradles. Similarly, "Implement #2" (the other 50 pound cradle), can be placed in either "Cradle #1" or "Cradle #2".

In the preferred embodiment the processor 28 is directly connected to each of the receivers 18, and therefore the processor can directly determine which receiver is transmitting an electrical signal corresponding to a sensed optical or RF signal (and thus which cradle has received the dumbbell 22), by determining on which incoming line the signal is being received. In an alternative embodiment, the transmitted signal from the receivers may include, along with the signal from the transmitter 17, identification information to identify which receiver is transmitting the signal to the processor. In this embodiment, the receivers can be connected to a multiplexer or the like (not shown), which transmits a multiplexed signal along a single signal line to the processor 28.

Figure 6:
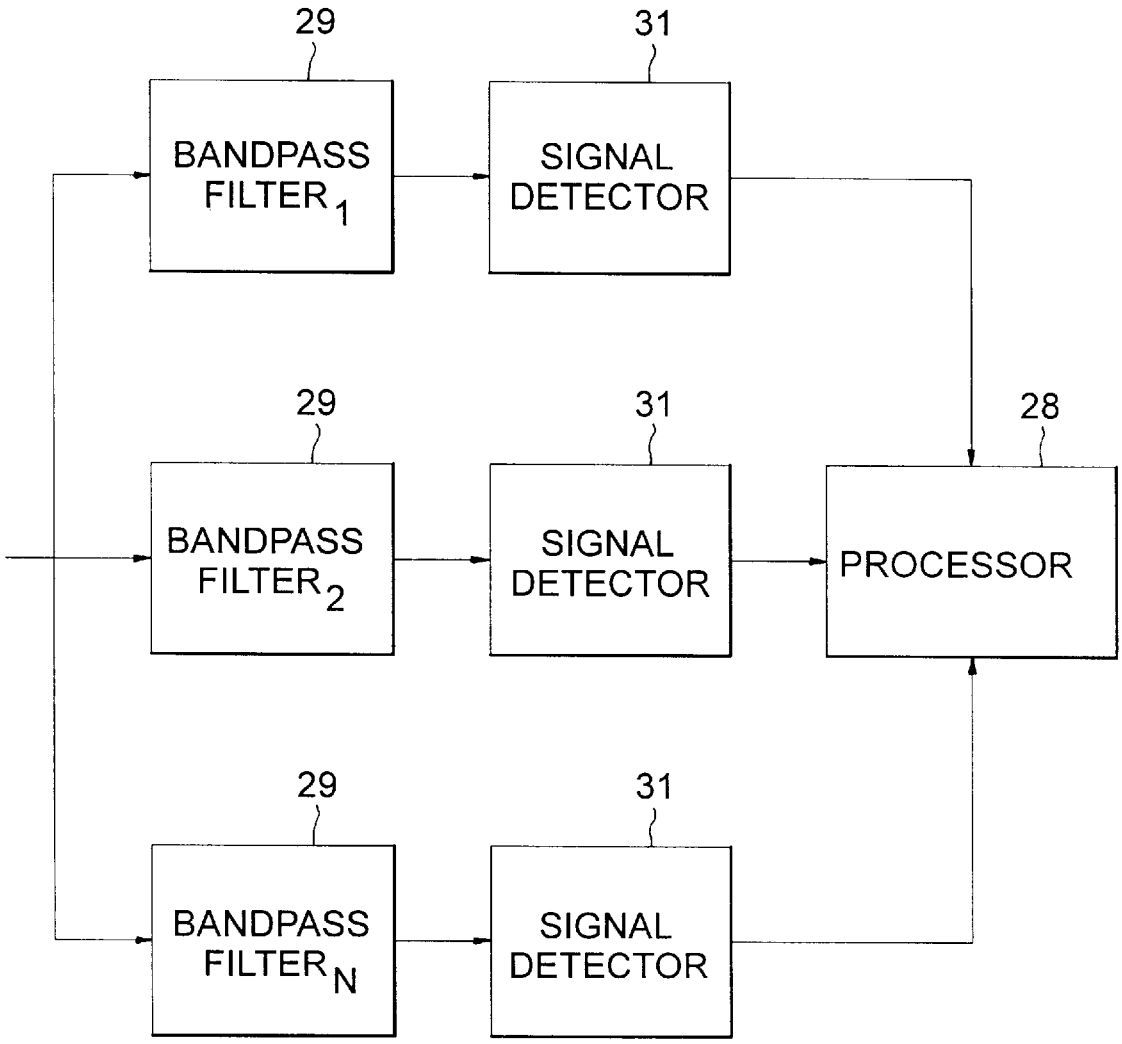
FIG. 6 is a block diagram of components included in one illustrative embodiment of the present invention.

As described above, in one embodiment the transmitters 17 each transmit an RF signal having a distinctive frequency. In that embodiment, the system 10 preferably includes either a tuner (not shown) controlled by the processor 28 to sequentially sample at different frequencies, or a plurality of parallel bandpass filters 29, each of which passes a different frequency range corresponding to the frequency of one of the transmitters 17, as shown in FIG. 6. In this manner, the RF signals transmitted from different transmitters can be distinguished based upon the frequency of the transmitted signal, such that the processor can determine which transmitter's signal is being received, and thus which dumbbell has been placed on the particular cradle of the rack by accessing the memory 30 as described in greater detail below.

In one illustrative embodiment, the system 10 is set to a particular sensitivity level, such that the system 10 only acknowledges signals received by the receivers that are above a selected threshold amplitude. This may be accomplished by providing one or more signal detectors 31 connected to the respective band pass filters 29 and which have minimum amplitude thresholds. This can effectively prevents misreads by receivers in adjacent cradles. It is well known that the signal intensity drops off at a rate proportional to the inverse square of the distance between the source and the destination. Thus, it will be readily apparent to those skilled in the art that the sensitivity level can be set to a selected level such that the signal detector only transmits the signal it receives to the processor once the dumbbell is actually placed in the corresponding cradle. With the dumbbell placed in the cradle, the signal received by the corresponding receiver is of sufficient intensity to exceed the preset threshold. This ensures that there are no positive readings (by any of the signal detectors) until the dumbbell is actually placed in a cradle. The respective signal detectors and bandpass filters can be incorporated in the processor 28 or can be separate components.

In one embodiment, each of the dumbbells 22 may incorporate a motion sensor (not shown) coupled to the corresponding transmitters 17 of that dumbbell, with the motion sensor being operative in response to the sensing of motion to trigger an internal switch and thereby actuate the transmitters 17 of the dumbbell, such that transmitters are actuated only when motion is detected and for a predetermined amount of time thereafter, for example, ten seconds. After the predetermined amount of time elapses, the transmitters are preferably deactivated. This provides sufficient time for the receivers 18 to receive signals from the transmitters, and efficiently saves power by shutting off the transmitters during inactive periods, such as when the dumbbells are racked for extended periods of time.

Referring to FIG. 3, the system 10 in one embodiment further comprises an alarm 34, which is electrically connected to the processor 28. Once the processor 28 has determined that a dumbbell 22 or other weight lifting implement has been improperly placed in one of the cradles 16 or in some other receptacle, the processor generates an error signal, which may be stored in the memory 30 along with the identity of the cradle that is housing the dumbbell. Alternatively, the processor may transmit the error signal in the form of a control signal to the alarm 34, to signal the alarm to generate a warning to the user that he or she has misplaced the dumbbell. The alarm may take many different forms, such as a buzzer or other audible alarm, a flashing light or other visual alarm, a combination thereof, or the like.

Each dumbbell 22 houses a power supply unit therein (not shown), preferably in the form of one or more batteries to supply electrical power to the corresponding transmitter 17 or transmitters to activate them. The power in the batteries may be conserved by the motion sensor and switch described above, or by any other well known means.

Figure 4:
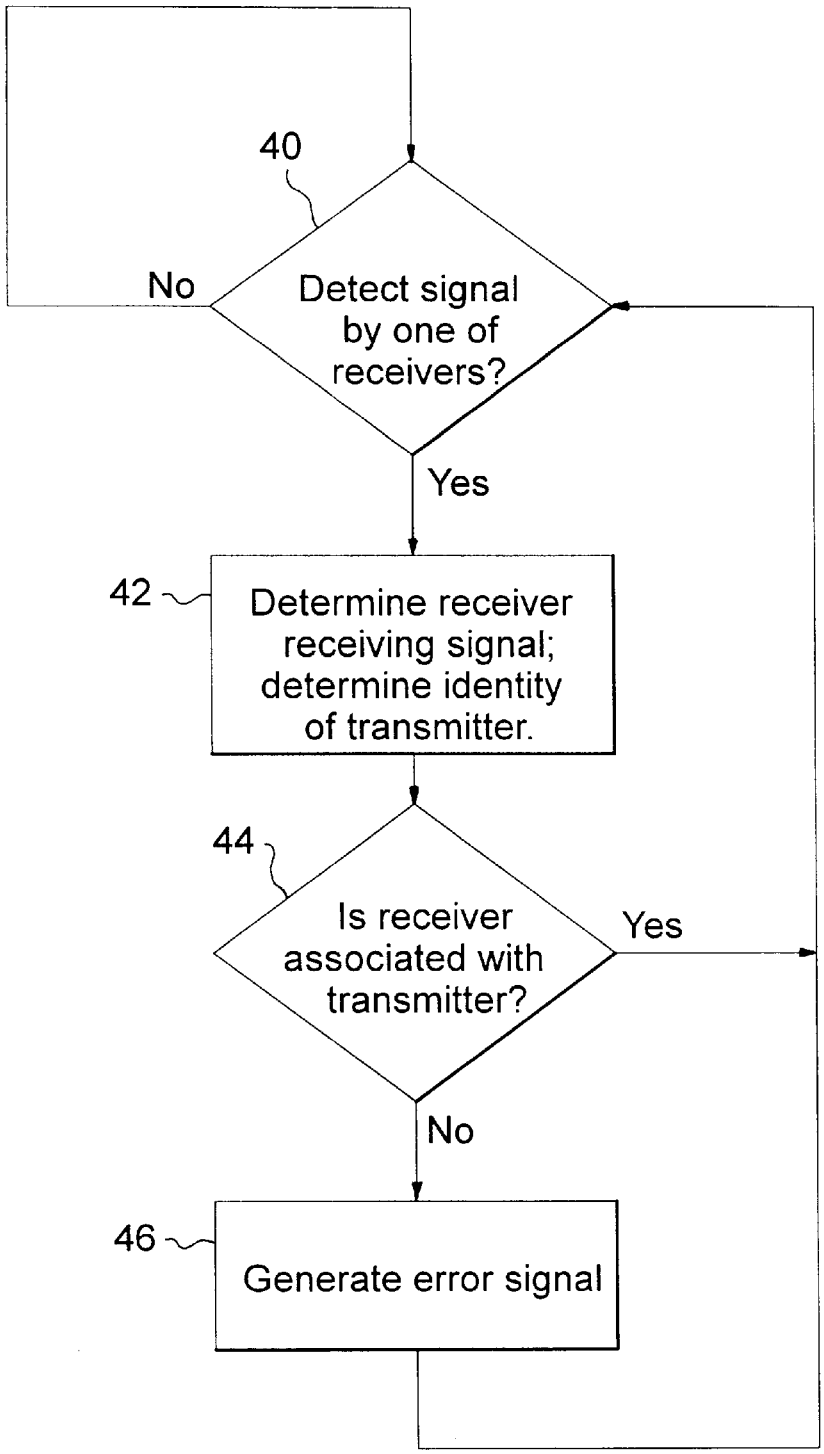
FIG. 4 is a flow chart illustrating the operational flow of the monitoring system of FIG. 1.

Referring now to FIG. 4, the operation of the system 10 will be described in greater detail. Operation begins at step 40, with the system 10 monitoring the respective receivers 18 to determine whether any of the receivers has detected a signal from one of the transmitters 17. In one illustrative embodiment, the receivers do not transmit an electrical signal to the processor 28 until the sensed signal exceeds a predetermined threshold, as dictated by the signal detectors 31. Operation remains at step 40 until the processor receives a signal from at least one of the receivers. Once a signal is received by the processor, operation proceeds to step 42, and the processor determines the identity of the transmitter 17 transmitting the signal, and of the receiver 18 sensing the signal. In one embodiment, this involves determining the frequency of the incoming RF signal (to determine which transmitter is being sensed), and determining which line is conducting the signal to the processor (to determine which receiver is sensing the RF signal). Operation then flows to step 44, and the processor 28 accesses the memory to determine whether the identified transmitter 17 is associated with the identified receiver 18. This is preferably accomplished by resorting to the association or look-up table 32, locating the appropriate address line 33, and determining whether the transmitter 17 and receiver 18 are linked in the table. If so, the dumbbell has been placed in the proper cradle, and operation proceeds back to step 40, with the system 10 waiting for the next dumbbell to be placed in a cradle. If, on the other hand, the identified transmitter and receiver are not linked in the association table, operation proceeds to step 46, and the processor generates the error signal, which may be stored in memory for future retrieval, or transmitted to the alarm device 34 to actuate the alarm and thereby alert the person replacing the dumbbell that the dumbbell has been placed in the wrong cradle.

It will be understood by those skilled in the art that the monitoring system 10 of the present invention may be used in connection with virtually any weight lifting implement, including barbells and other mobile weight lifting devices.

In addition, while in one embodiment the signals from the transmitters 17 are distinguished based on frequency, it will be apparent that other methods may be used. For example, the signals can be distinguished based on amplitude, phase, or any other well known signal-differentiating method.

Figure 7:
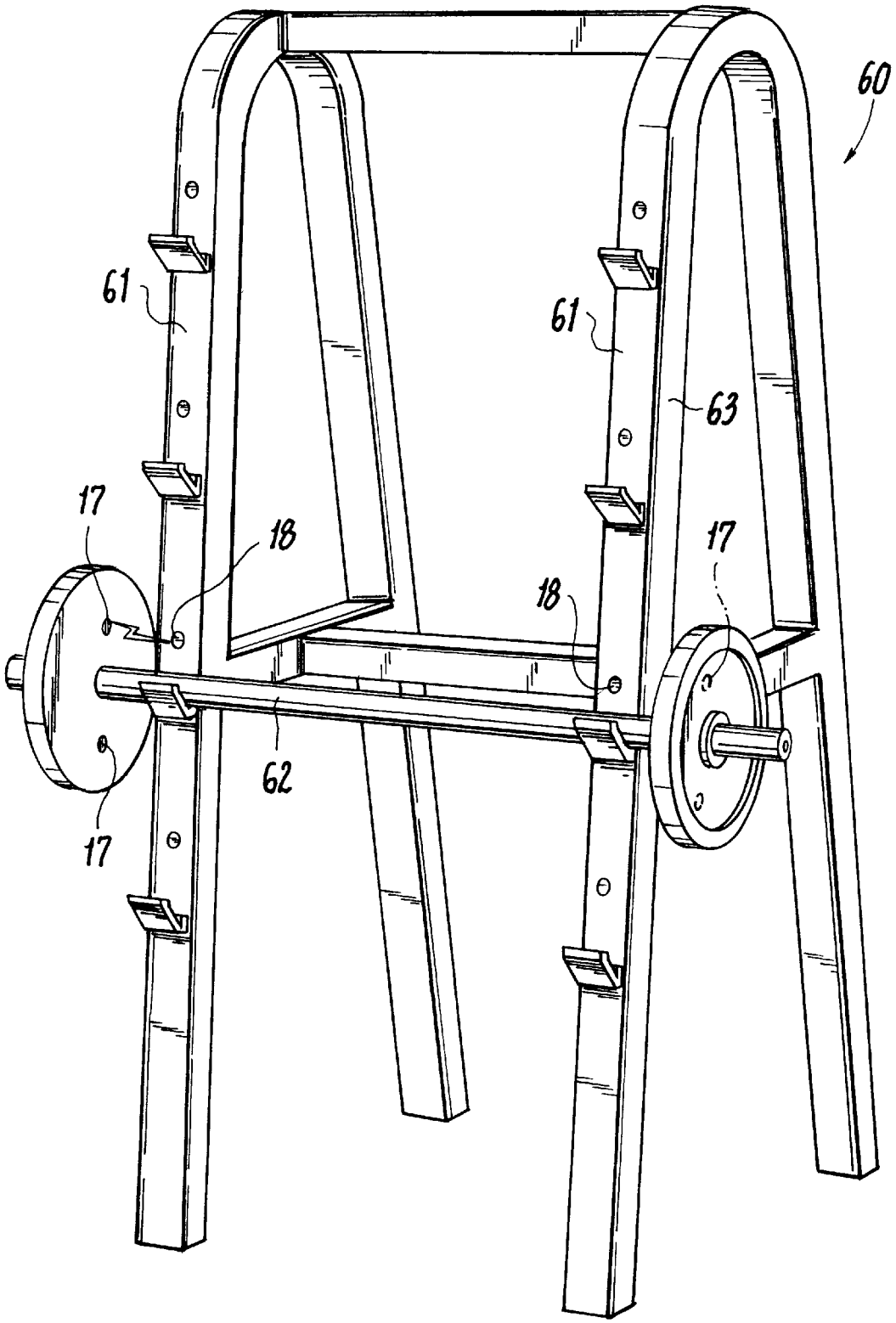
FIG. 7 is a perspective view of the present invention embodied in a barbell rack.
Figure 8:
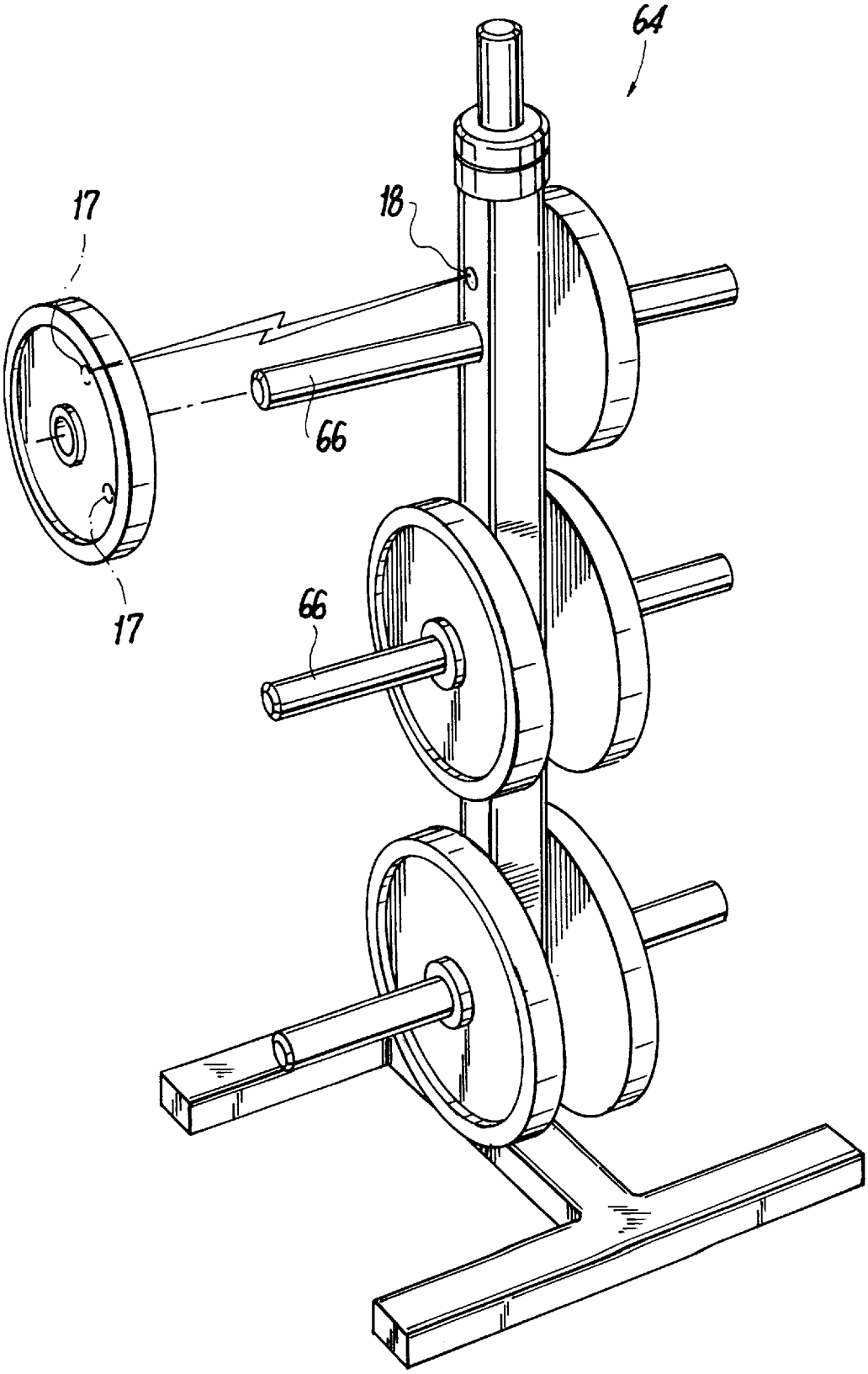
FIG. 8 is a perspective view of the present invention embodied in a plate tree.

Referring to FIGS. 7 and 8, the weight lifting implement monitoring system 10 may be incorporated in many different types of weight lifting storage devices. For example, in FIG. 7 the system is incorporated into a barbell rack 60 which racks plural barbells 62. Mounted into the plate of each barbell is one or more transmitters 17, as described above in connection with the dumbbells 22. Receivers 18 are disposed on the barbell rack at selected locations to receive signals from the respective transmitters. The system then operates in the same manner mentioned above in connection with FIGS. 1 through 6. While the receivers are shown mounted on the forward facing surfaces 61 of the rack 60, they can alternatively be placed on the side surfaces 63 of the rack, or at any other suitable location.

The system 10 may also be incorporated into a plate tree 64 (FIG. 8) which includes outwardly projecting cylindrical posts 66 to receive respective weight plates 68. Plural receivers 18 are disposed at selected locations on the plate tree to sense signals from transmitters 17 mounted on the weight plates. The system then operates in the same manner mentioned above in connection with FIGS. 1 through 6.

From the foregoing, it will be apparent that the present invention provides a reliable, efficient monitoring system for detecting and identifying weight lifting implements returned to a weight lifting storage device, such as a rack, and for generating an error signal, which may be in the form of an audible or visual signal, in the event the weight lifting implement is placed in the wrong receptacle of the storage device. The storage device may take many different forms, such as different types of dumbbell racks, barbell racks, plate trees, and the like.

While the invention has been particularly shown and described with reference to illustrative embodiments thereof, it will be understood by those skilled in the art that various changes in form and details may be made therein without departing from the spirit and scope of the invention. Accordingly, it is not intended that the invention be limited, except as by the appended claims.

What is claimed is:

1. A system for monitoring plural weight lifting implements, the system comprising:

a weight lifting storage device with plural receptacles, each receptacle being configured to receive a respective one of the weight lifting implements;

plural transmitters, each transmitter connected to a respective one of the implements and operative to transmit a unique identification signal to identify the corresponding implement;

plural receivers mounted on the weight lifting storage device at predetermined locations, each receiver being responsive to receipt of an identification signal from one of the transmitters to generate a corresponding signal;

a memory associating each of the receivers with a corresponding transmitter; and a processor in electrical communication with the receivers and programmed to receive the corresponding signals from the receivers, access the memory to determine if the receiver transmitting the signal corresponds to the transmitter generating the identification signal and, if not, generate an error signal.

2. The system of claim 1, wherein the transmitters transmit radio frequency signals.

3. The system of claim 1 for use with dumbbells including handles and a pair of heads at the respective ends of the handle, wherein the transmitters are mounted in the heads of the respective dumbbells.

4. The system of claim 1, wherein one of the receivers is mounted in each of the receptacles.

5. The system of claim 1 further including an alarm electrically connected to the processor and responsive to receipt of the error signal to generate an alarm signal.

6. The system of claim 5, wherein the alarm is operative to generate an audible alarm signal.

7. The system of claim 1, wherein the corresponding signals from the receivers identify the respective transmitters, and the memory is configured to associate the corresponding signals with the respective receivers.

8. A system for monitoring plural weight lifting implements stored on a weight lifting storage device, the storage device defining plural receptacles to receive the implements, the system comprising:

plural transmitters, each of which is connected to a respective one of the implements and is operative to transmit a unique identification signal to identify the corresponding implement;

plural receivers;, each of which is mounted on the weight lifting storage device at a predetermined location and is responsive to receipt of an identification signal from one of the transmitters to generate a corresponding unique signal;

a memory associating each of the receivers with a corresponding transmitter; and a processor in electrical communication with the receivers and programmed to receive the unique signals from the respective receivers, access the memory to determine whether the receiver transmitting the signal is associated with the transmitter transmitting the unique identification signal, and to generate an error signal if the receiver is not associated with the transmitter.

9. The system of claim 8, wherein the transmitters transmit radio frequency signals.

10. The system of claim 8 for use with dumbbells including handles and a pair of heads at the respective ends of the handle, wherein the transmitters are mounted in the heads of the respective dumbbells.

11. The system of claim 8, wherein one of the receivers is mounted in each of the receptacles.

12. The system of claim 8 further including an alarm electrically connected to the processor and responsive to receipt of the error signal to generate an alarm signal.

13. The system of claim 12, wherein the alarm is operative to generate an audible alarm signal.

14. The system of claim 8, wherein the corresponding unique signals from the receivers identify the respective transmitters, and the memory is configured to associate the corresponding signals with the respective receivers.

15. A method of automatically monitoring plural weight lifting implements comprising:

associating the implements with respective receptacles of a weight lifting storage device;

sensing an implement being deposited in one of the receptacles;

determining the identity of the implement;

determining whether the implement is associated with the receptacle in which the implement is deposited; and actuating an alarm if the implement is not associated with the receptacle.

16. The method of claim 15, wherein the step of actuating an alarm comprises actuating an audible alarm.

17. The method of claim 15, wherein the step of actuating an alarm comprises actuating a visible indicator.

18. The method of claim 15, wherein the step of associating the implements and receptacles includes providing an association table with plural address lines, and of storing in the association table links between implements and corresponding receptacles.

19. The method of claim 18, wherein the step of determining whether the implement is associated with the receptacle in which the implement is deposited involves accessing the association table.

20. The method of claim 15, wherein the step of sensing an implement being deposited in one of the receptacles includes providing a transmitter on the implement and a receiver on the receptacle, and receiving by the receiver a signal transmitted by the transmitter.

* * * * *